US010947655B2

(12) United States Patent
Makiyama et al.

(10) Patent No.: US 10,947,655 B2
(45) Date of Patent: Mar. 16, 2021

(54) SEWING MACHINE

(71) Applicant: BROTHER KOGYO KABUSHIKI KAISHA, Nagoya (JP)

(72) Inventors: Kouji Makiyama, Tokai (JP); Fumihiro Nonobe, Inuyama (JP); Nobuhiko Funato, Gifu (JP); Yasuhiko Kawaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 56 days.

(21) Appl. No.: 16/421,105

(22) Filed: May 23, 2019

(65) Prior Publication Data

US 2019/0368093 A1 Dec. 5, 2019

(30) Foreign Application Priority Data

May 31, 2018 (JP) ..... JP2018-104256

(51) Int. Cl.
*D05B 43/00* (2006.01)
*D05B 73/00* (2006.01)

(52) U.S. Cl.
CPC ..... *D05B 43/00* (2013.01); *D05B 73/005* (2013.01); *D05D 2207/06* (2013.01)

(58) Field of Classification Search
CPC ..... D05B 73/005; D05B 43/00; B65H 49/16
See application file for complete search history.

(56) References Cited

U.S. PATENT DOCUMENTS

| | | | | |
|---|---|---|---|---|
| 3,665,875 | A * | 5/1972 | Bantor | D05B 59/00 112/279 |
| 3,749,039 | A * | 7/1973 | Fritts | D05B 51/00 112/302 |
| 9,346,650 | B2 * | 5/2016 | Niizeki | D05B 43/00 |
| 2015/0239707 | A1 | 8/2015 | Niizeki | |
| 2018/0010275 | A1 * | 1/2018 | Fujihara | D05B 43/00 |

FOREIGN PATENT DOCUMENTS

JP 2015-159946 A 9/2015

* cited by examiner

*Primary Examiner* — Tajash D Patel
(74) *Attorney, Agent, or Firm* — Oliff PLC

(57) ABSTRACT

A sewing machine includes a bed portion, a pillar, an arm portion, a cover, and a thread spool device. The cover is provided on the arm portion and is rotatable between a closed position and an open position. The closed position is a position in which a base surface faces an upper side of the arm portion and the base surface covers the upper side of the arm portion. The open position is a position in which the base surface is directed upward and the base surface does not cover the upper side of the arm portion. The thread spool device is provided on the base surface and including at least one thread spool pin, the thread spool device being capable of holding a thread spool on each of the at least one thread spool pin in a state in which the cover is disposed in the open position.

14 Claims, 13 Drawing Sheets

SEWING MACHINE

CROSS-REFERENCE TO RELATED APPLICATION

This application claims priority to Japanese Patent Application No. 2018-104256, filed on May 31, 2018, the content of which is hereby incorporated by reference.

BACKGROUND

The present disclosure relates to a sewing machine.

A sewing machine on which a thread spool device can be mounted is known. The known sewing machine has a cover member that covers a part of an arm portion such that the part of the arm portion can be opened and closed. The cover member is detachably and rotatably attached to an attachment portion that is provided on the arm portion. When the thread spool device is mounted on the sewing machine, first, the cover member is removed from the arm portion. As a result, the attachment portion is exposed. Next, the thread spool device is mounted on the exposed attachment portion.

SUMMARY

With the above-described sewing machine, it is necessary to remove the cover member from the arm portion in order to mount the thread spool device on the sewing machine. Therefore, there is a problem that a removal operation of the cover member, which is troublesome, is required to cause the sewing machine to be in a state in which the thread spool device can be used.

It is an object of the present disclosure to provide a sewing machine in which a thread spool device is brought into a usable state by an easy operation.

A sewing machine according to the present disclosure includes a bed portion, a pillar, an arm portion, a cover, and a thread spool device. The pillar extends upward from the bed portion. The arm portion extends from an upper end portion of the pillar in parallel with the bed portion. The cover is provided on the arm portion and is configured to be rotatable between a closed position and an open position. The closed position is a position in which a base surface, which is a part of a surface of the cover, faces an upper side of the arm portion and the base surface covers the upper side of the arm portion. The open position is a position in which the base surface is directed upward and the base surface does not cover the upper side of the arm portion. The thread spool device is provided on the base surface and including at least one thread spool pin. The thread spool device is capable of holding a thread spool on each of the at least one thread spool pin in a state in which the cover is disposed in the open position.

BRIEF DESCRIPTION OF THE DRAWINGS

Embodiments of the disclosure will be described below in detail with reference to the accompanying drawings in which.

DETAILED DESCRIPTION OF EMBODIMENTS

An embodiment of the present disclosure will be explained with reference to the drawings. The up-down direction, the lower left side, the upper right side, the upper left side and the lower right side of FIG. 1 respectively correspond to the up-down direction, the front side, the rear side, the left side and the right side of a sewing machine 1A. The longitudinal direction of a bed portion 11 and an arm portion 13 is the left-right direction of the sewing machine 1A. The side on which a pillar 12 is disposed is the right side. The extending direction of the pillar 12 is the up-down direction of the sewing machine 1A.

Overall Configuration of Sewing Machine 1A

Figure 1:
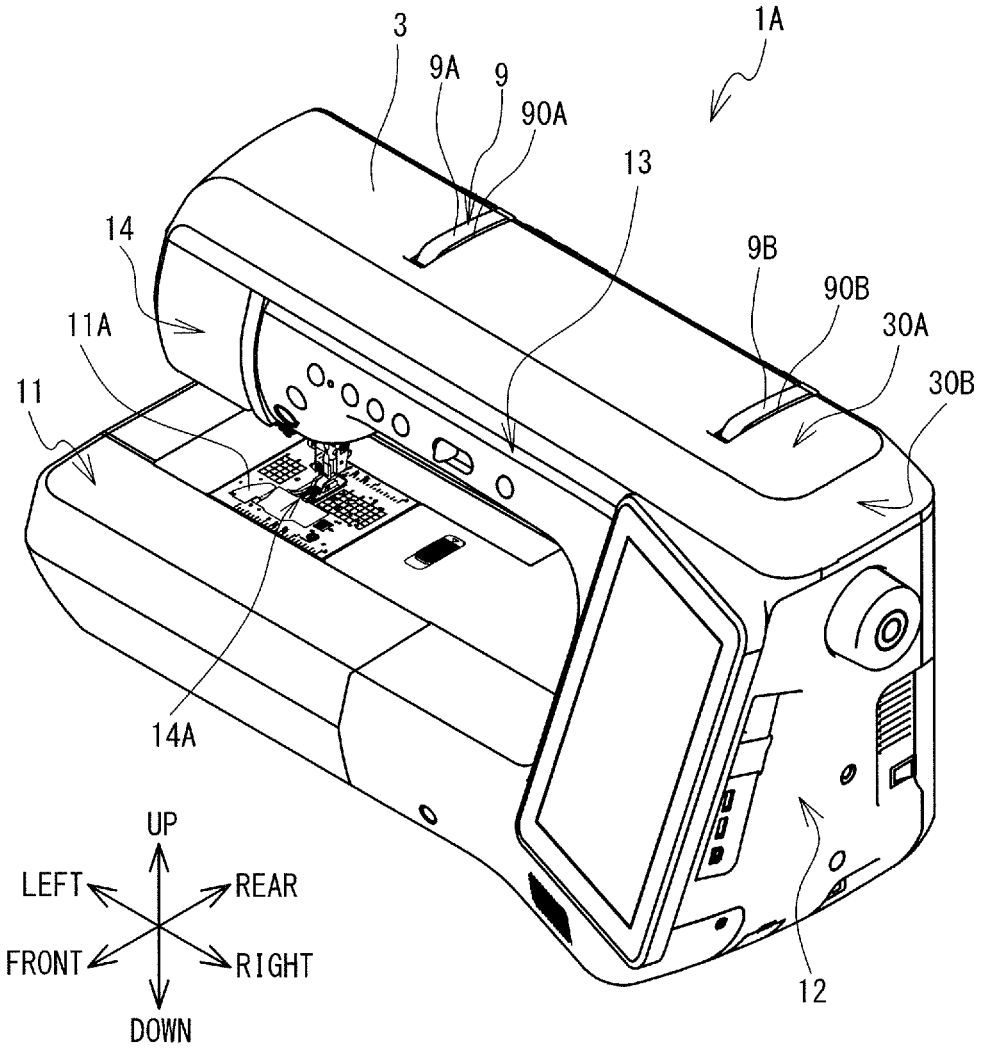
FIG. 1 is a perspective view of a sewing machine 1A on which a cover 3 is disposed in a closed position.
Figure 2:
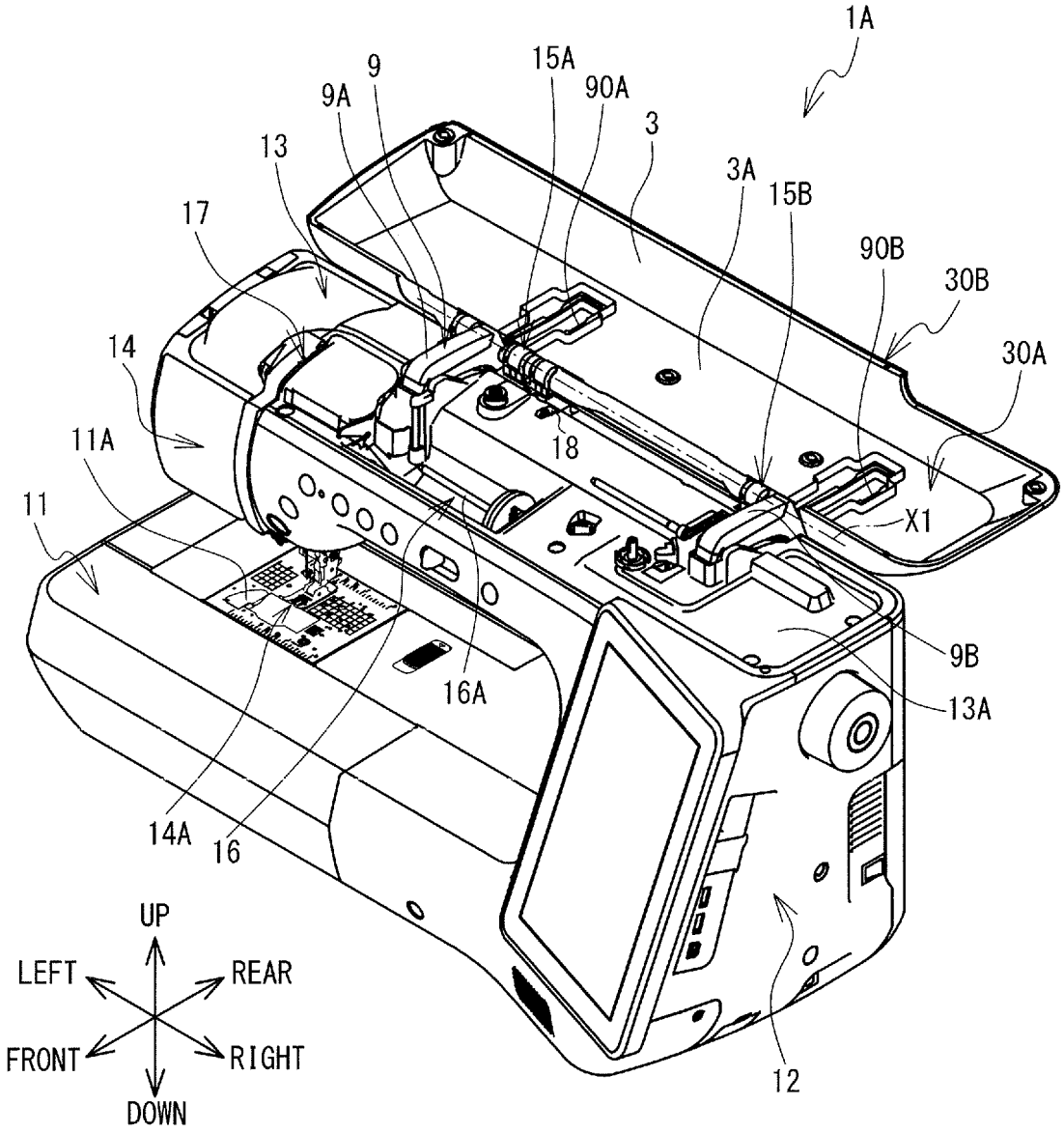
FIG. 2 is a perspective view of the sewing machine 1A on which the cover 3 is disposed in an open position.

As shown in FIG. 1 and FIG. 2, the sewing machine 1A is provided with the bed portion 11, the pillar 12, the arm portion 13 and a head portion 14. The bed portion 11 is a base portion of the sewing machine 1A and extends in the left-right direction. The pillar 12 extends upward from the right end portion of the bed portion 11. The arm portion 13 extends to the left from the upper end portion of the pillar 12 such that the arm portion 13 is parallel to the bed portion 11. The head portion 14 is coupled to the left end portion of the arm portion 13. A needle bar and a presser bar extend downward from the lower end portion of the head portion 14. A sewing needle is detachably mounted on the lower end of the needle bar. A presser foot 14A is detachably mounted on the lower end portion of the presser bar.

A feed dog, a feed mechanism, a shuttle mechanism and the like, which are not shown in the drawings, are provided inside the bed portion 11 of the sewing machine 1A. The feed dog is driven by the feed mechanism and moves a sewing object by a predetermined movement amount. The shuttle mechanism entwines an upper thread (not shown in the drawings) with a lower thread (not shown in the drawings) below a needle plate 11A that is provided on the upper surface of the bed portion 11. A sewing machine motor (not shown in the drawings) is provided inside the pillar 12.

Figure 3:
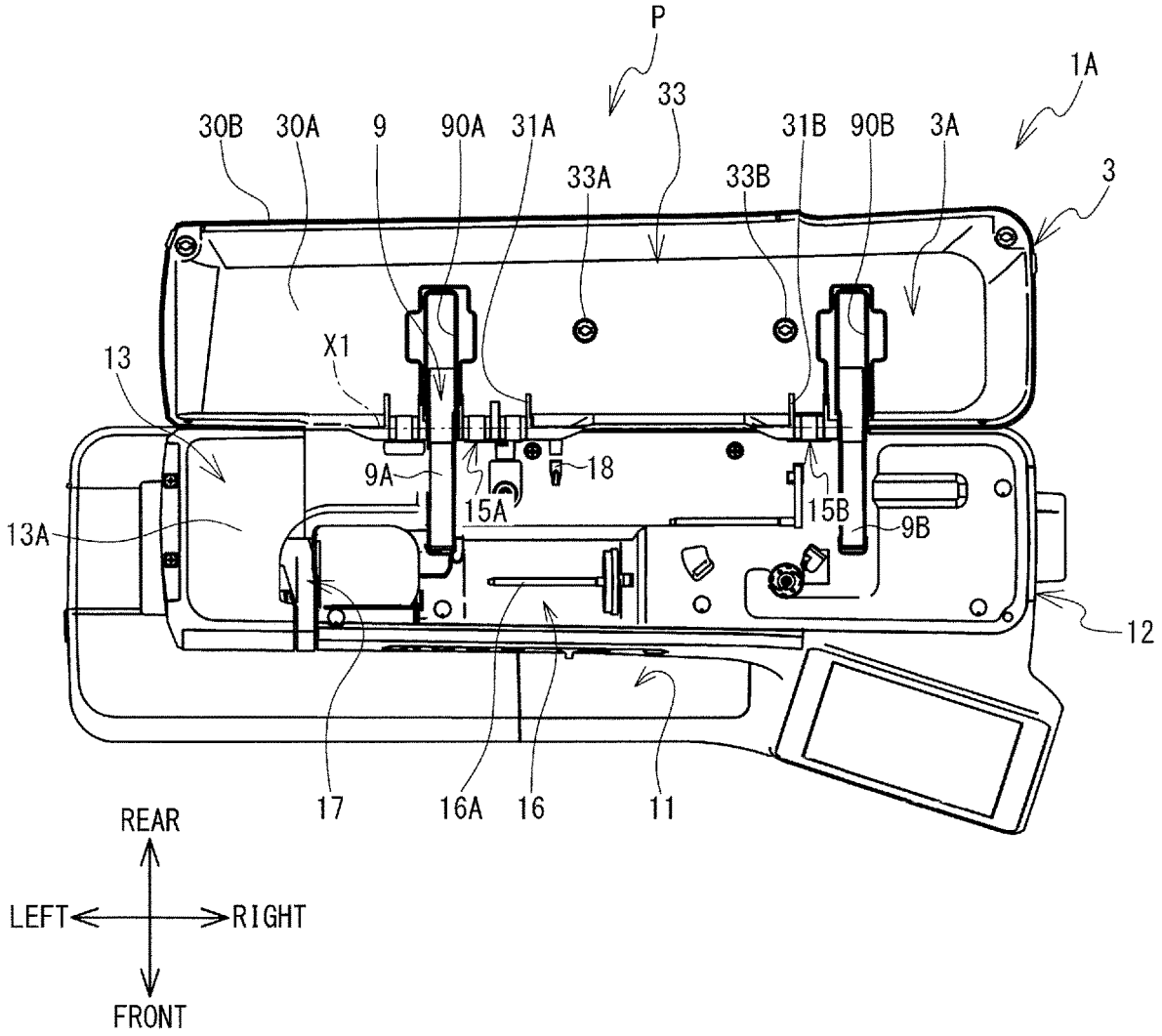
FIG. 3 is a plan view of the sewing machine 1A on which the cover 3 is disposed in the open position.

An upper portion of the arm portion 13 is provided with a cover 3 that can open and close. As shown in FIG. 2 and FIG. 3, the cover 3 is connected to hinges 15A and 15B that are provided on the rear end portion of the arm portion 13. Owing to the hinges 15A and 15B, the cover 3 is supported by the arm portion 13 such that the cover 3 can rotate around a rotation axis X1 that extends in the left-right direction. FIG. 1 shows a state in which the cover 3 is in a closed state. A position of the cover 3 in the closed state is referred to as a "closed position." FIG. 2 and FIG. 3 show a state in which the cover 3 is open. A position of the cover 3 in the open state is referred to as an "open position." The cover 3 will be described in detail later.

As shown in FIG. 2 and FIG. 3, two end portions 9A and 9B of a substantially U-shaped handle 9 are rotatably supported by a surface (referred to as an "upper surface 13A") on the upper side of the arm portion 13. FIG. 2 and FIG. 3 show a state in which the handle 9 is down. In this state, the end portions 9A and 9B respectively extend to the rear from sections of the handle 9 that are supported by the upper surface 13A. The end portion 9A is arranged to the left of and separated from the end portion 9B. Note that the handle 9 is raised from the state shown in FIG. 2 and FIG. 3 by being rotated counterclockwise in a right side view. In this state, a user can lift up the sewing machine 1A by grasping the raised handle 9.

The upper surface 13A is further provided with a thread housing portion 16. The thread housing portion 16 has a shape that is recessed downward. A thread spool (not shown in the drawings), around which the upper thread is wound, can be housed in the thread housing portion 16. A thread spool pin 16A is provided on an inner peripheral surface on the right side of the thread housing portion 16. The thread spool pin 16A extends to the left from the inner peripheral surface on the right side of the thread housing portion 16. The thread spool is mounted on the sewing machine 1A by the thread spool pin 16A being inserted into an insertion hole of the thread spool. A third thread guide portion 17 is provided in the upper surface 13A, on the left side of the thread housing portion 16. The third thread guide portion 17 is a curved groove. The third thread guide portion 17 guides the upper thread pulled out from the thread spool housed in the thread housing portion 16, to the sewing needle. A drive shaft (not shown in the drawings) that extends in the left-right direction is provided inside the arm portion 13. The drive shaft is driven to rotate by the sewing machine motor. The upper surface 13A is further provided with a first thread guide portion 18 on the rear side of the thread housing portion 16. The first thread guide portion 18 is a hook. The first thread guide portion 18 hooks the upper thread drawn out from the thread spool mounted on a thread spool device 5 (refer to FIG. 4 and FIG. 5) to be described later, and guides the upper thread toward the third thread guide portion 17.

The head portion 14 is provided with a needle bar up-and-down movement mechanism (not shown in the drawings) and a presser foot up-and-down movement mechanism (not shown in the drawings). The needle bar up-and-down movement mechanism drives the needle bar, on which the sewing needle is mounted, in the up-down direction in accordance with the rotation of the drive shaft. The presser foot up-and-down movement mechanism drives the presser bar, on which the presser foot 14A is mounted, in the up-down direction in accordance with the rotation of the drive shaft.

Cover 3

As shown in FIG. 1 to FIG. 3, the cover 3 has plate portions 30A and 30B. The plate portion 30A has a rectangular shape that is long in the left-right direction. The plate portion 30B extends in a direction that intersects the plate portion 30A, from a peripheral edge portion of the plate portion 30A. A through hole 90A, through which the end portion 9A of the handle 9 passes in a state (refer to FIG. 1) in which the cover 3 is disposed in the closed position, and a through hole 90B, through which the end portion 9B of the handle 9 passes, are formed in the cover 3.

As shown in FIG. 1, in the state in which the cover 3 is disposed in the closed position, the plate portion 30A is orthogonal to the up-down direction. The lower surface of the plate portion 30A is located above and faces the upper surface 13A (refer to FIG. 2) of the arm portion 13. Hereinafter, the surface which is on one side of the plate portion 30A and which faces the upper surface 13A of the arm portion 13 in the state in which the cover 3 is disposed in the closed position (namely, the surface on the lower side in FIG. 1) is referred to as a base surface 3A (refer to FIG. 2). In the state in which the cover 3 is disposed in the closed position, the base surface 3A covers the upper surface 13A from above. Note that a form of the state in which the cover 3 is disposed in the closed position is not limited to the present embodiment. For example, in the state in which the cover 3 is disposed in the closed position, the base surface 3A may be directed downward and may cover only a part of the upper surface 13A of the arm portion 13 from above. In other words, when the cover 3 is disposed in the closed position, it is sufficient that the base surface 3A is directed downward and covers at least a part of the upper surface 13A of the arm portion 13 from above.

The cover 3 is disposed in the open position by being rotated around the rotation axis X1 (refer to FIG. 2) by 180 degrees clockwise in a right side view from the state in which the cover 3 is disposed in the closed position. As shown in FIG. 2, in a state in which the cover 3 is disposed in the open position, the plate portion 30A is orthogonal to the up-down direction and the base surface 31 is directed upward. The base surface 3A does not cover the upper surface 13A of the arm portion 13, and the upper surface 13A is exposed. Hereinafter, in order to facilitate understanding, unless otherwise stated, it is assumed that the cover 3 is disposed in the open position, and each direction of the sewing machine 1A is applied to the cover 3.

As shown in FIG. 3, first convex portions 31A and 31B and magnets 33A and 33B are provided on a section of the base surface 3A between the through holes 90A and 90B in the left-right direction. The first convex portions 31A and 31B protrude upward from the base surface 3A. The magnets 33A and 33B are fixed to the base surface 3A.

The first convex portion 31A is a rib to attach the hinge 15A to the cover 3. The first convex portion 31A is provided on a front end portion of the base surface 3A and to the right of the through hole 90A. The first convex portion 31B is a rib to attach the hinge 15B to the cover 3. The first convex portion 31B is provided on the front end portion of the base surface 3A and to the left of the through hole 90B. The first convex portions 31A and 31B have a plate shape. The first convex portions 31A and 31B are orthogonal to the left-right direction. The first convex portions 31A and 31B are aligned in the left-right direction. The first convex portion 31A is disposed to the left of the first convex portion 31B.

The magnet 33A is provided to the right of the first convex portion 31A in the left-right direction. The magnet 33A is disposed in the vicinity of a central portion of the base surface 3A in the front-rear direction. The magnet 33B is provided at a substantially the same position as the first convex portion 31B in the left-right direction. The magnet 33B is disposed in the vicinity of the central portion of the base surface 3A in the front-rear direction. The magnets 33A and 33B are aligned in the left-right direction. Hereinafter, the magnets 33A and 33B are collectively referred to as a "first attachment portion 33."

Thread Spool Device 5

The thread spool device 5 will be explained with reference to FIG. 4 to FIG. 6. The thread spool device 5 can hold two thread spools and can draw out the upper thread of each of the thread spools onto the sewing machine 1A. The thread spool device 5 is mounted on the cover 3 disposed in the open position and is used (refer to FIG. 7 and FIG. 8). Hereinafter, in order to facilitate understanding, unless otherwise stated, it is assumed that the thread spool device 5 is mounted on the cover 3 disposed in the open position, and each direction of the sewing machine 1A is applied to the cover 3.

Figure 4:
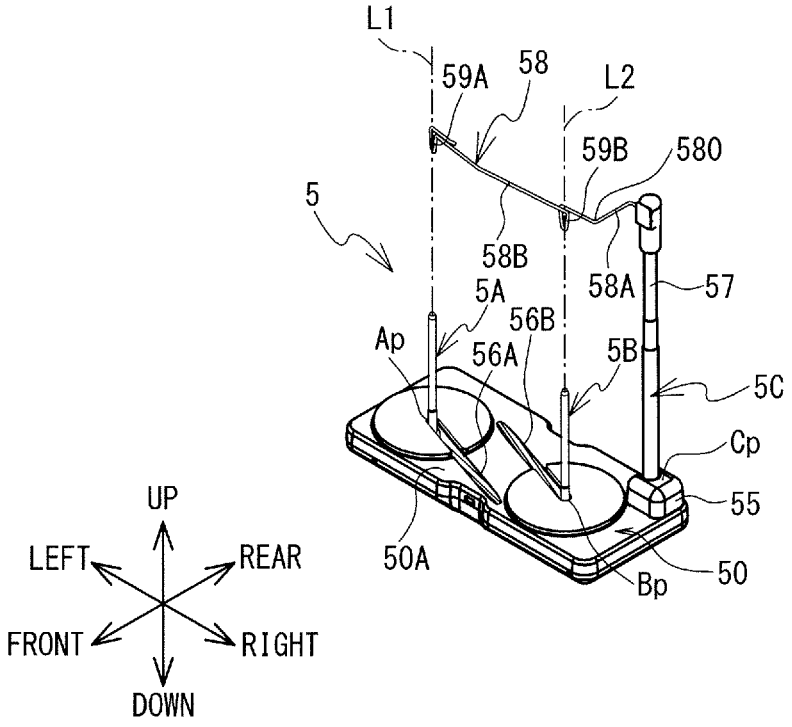
FIG. 4 is a perspective view of a thread spool device 5 in which thread spool pins 5A and 5B are each disposed in a first position, a thread guide pin 57 is disposed in a third position, and a support pin 58 is disposed in a fifth position.
Figure 5:
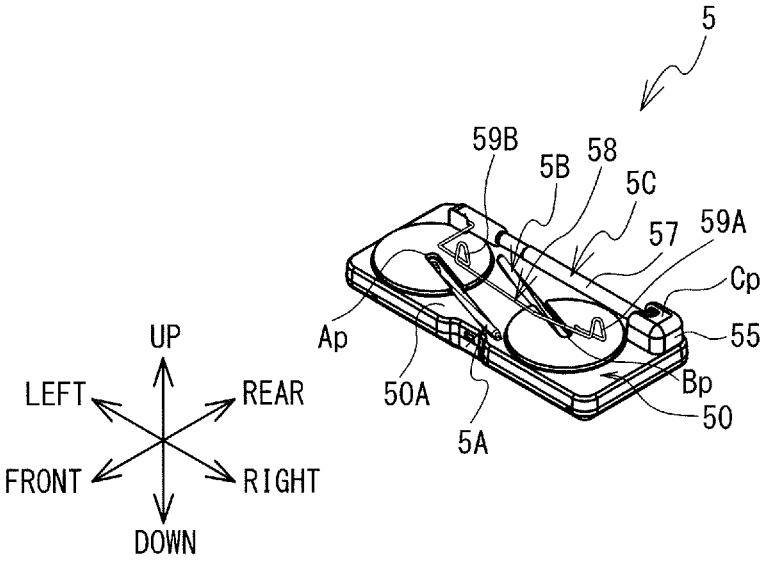
FIG. 5 is a perspective view of the thread spool device 5 in which the thread spool pins 5A and 5B are each disposed in a second position, the thread guide pin 57 is disposed in a fourth position, and the support pin 58 is disposed in a sixth position.

As shown in FIG. 4 and FIG. 5, the thread spool device 5 has a thread spool base 50. The thread spool base 50 has a rectangular plate shape that is long in the left-right direction. The thread spool device 5 is provided with thread spool pins 5A and 5B (refer to FIG. 4 and FIG. 5), a thread guide mechanism 5C (refer to FIG. 4 and FIG. 5), first grooves 51A and 51B (refer to FIG. 6), magnets 53A and 53B (refer to FIG. 6), and second grooves 56A and 56B (refer to FIG. 4).

The thread spool pins 5A and 5B hold the thread spools in a state in which the thread spool pins 5A and 5B are respectively inserted into insertion holes of the thread spools (not shown in the drawings), around each of which the upper thread is wound. As shown in FIG. 4 and FIG. 5, the thread spool pins 5A and 5B have a bar shape. The thread spool pins 5A and 5B have the same length as each other. Each of the thread spool pins 5A and 5B is provided so as to be rotatable with respect to the thread spool base 50 around a rotation axis that is orthogonal to the extending direction. A position of each of the thread spool pins 5A and 5B shown in FIG. 4 is referred to as a "first position," and a position of each of the thread spool pins 5A and 5B shown in FIG. 5 is referred to as a "second position." Each of the thread spool pins 5A and 5B can be switched between the first position and the second position that are two different positions. The thread spool pin 5A is rotatably supported inside the thread spool base 50, at a position Ap which is to the left of the center of the thread spool base 50 in the left-right direction and which is at the center of the thread spool base 50 in the front-rear direction. The thread spool pin 5B is rotatably supported inside the thread spool base 50, at a position Bp which is to the right of the center of the thread spool base 50 in the left-right direction and which is at the center of the thread spool base 50 in the front-rear direction. The positions Ap and Bp are aligned in the left-right direction. As shown in FIG. 4, the thread spool pin 5A extends upward from the position Ap of the thread spool base 50 in a state in which the thread spool pin 5A is disposed in the first position. The thread spool pin 5B extends upward from the position Bp in a state in which the thread spool pin 5B is disposed in the first position. The thread spool pin 5A is disposed to the left of the thread spool pin 5B. The thread spool pins 5A and 5B are disposed to be aligned in the left-right direction.

As shown in FIG. 4, the second grooves 56A and 56B that are recessed downward are provided in an upper surface 50A of the thread spool base 50. The second groove 56A extends to the right from the position Ap, along the left-right direction. More specifically, the second groove 56A extends from the position Ap diagonally toward the front right side. At the position Ap, the depth of the second groove 56A is slightly larger than the diameter of the thread spool pin 5A. The depth of the second groove 56A becomes smaller as the second groove 56A separates from the position Ap. The second groove 56B extends to the left from the position Bp, along the left-right direction. More specifically, the second groove 56B extends from the position Bp diagonally toward the rear left side. At the position Bp, the depth of the second groove 56B is slightly larger than the diameter of the thread spool pin 5B. The depth of the second groove 56B becomes smaller as the second groove 56B separates from the position Bp.

As shown in FIG. 5, the thread spool pin 5A enters the second groove 56A when it is disposed in the second position, and extends in the same direction as the second groove 56A. Note that, since the second groove 56A extends along the left-right direction, the thread spool pin 5A also extends along the left-right direction. More specifically, the thread spool pin 5A extends to the right from the position Ap that corresponds to a connection portion with the thread spool base 50. Further, more specifically, the thread spool pin 5A extends diagonally to the front right side along the second groove 56A, from the position Ap toward an end portion (referred to as a "leading end of the thread spool pin 5A") on the opposite side to the position Ap side. Further, since the depth of the second groove 56A becomes smaller as the second groove 56A separates from the position Ap, a part of the thread spool pin 5A on the leading end side protrudes above the upper surface 50A of the thread spool base 50.

In a similar manner, the thread spool pin 5B enters the second groove 56B when it is disposed in the second position, and extends in the same direction as the second groove 56B. Note that, since the second groove 56B extends along the left-right direction, the thread spool pin 5B also extends along the left-right direction. More specifically, the thread spool pin 5B extends to the left from the position Bp that corresponds to a connection portion with the thread spool base 50. Further, more specifically, the thread spool pin 5B extends diagonally to the rear left side along the second groove 56B, from the position Bp toward an end portion (referred to as a "leading end of the thread spool pin 5B") on the opposite side to the position Bp side. Further, since the depth of the second groove 56B becomes smaller as the second groove 56B separates from the position Bp, a part of the thread spool pin 5B on the leading end side protrudes above the upper surface 50A of the thread spool base 50.

The thread guide mechanism 5C uses second thread guide portions 59A and 59B (to be described later) to upwardly guide the upper thread that is drawn out from each of the thread spools (not shown in the drawings) respectively held by the thread spool pins 5A and 5B disposed in the first position. As shown in FIG. 4 and FIG. 5, the thread guide mechanism 5C has a thread guide pin 57 and a support pin 58. The thread guide pin 57 has a bar shape. The length of the thread guide pin 57 is substantially the same as the length of the thread spool base 50 in the left-right direction, and is longer than the thread spool pins 5A and 5B. The thread guide pin 57 holds the support pin 58 to be described later at the leading end portion thereof. The thread guide pin 57 is supported by a protruding portion 55 such that the thread guide pin 57 can rotate around a rotation axis that is orthogonal to the extending direction of the thread guide pin 57. The protruding portion 55 is provided at a position Cp, which is a rear right corner among four corners of the upper surface 50A of the thread spool base 50. The position of the thread guide pin 57 shown in FIG. 4 is referred to as a "third position," and the position of the thread guide pin 57 shown in FIG. 5 is referred to as a "fourth position." The thread guide pin 57 can be rotated and switched between the third position and the fourth position that are two different positions. As shown in FIG. 4, when the thread guide pin 57 is disposed in the third position, the thread guide pin 57 extends upward from the position Cp of the thread spool base 50. As shown in FIG. 5, when the thread guide pin 57 is disposed in the fourth position, the thread guide pin 57 extends to the left along the upper surface 50A from the position Cp of the thread spool base 50.

The support pin 58 is a bent wire. The support pin 58 is provided at an end portion of the thread guide pin 57 (hereinafter referred to as a "leading end of the thread guide pin 57") on the opposite side to the position Cp side. The support pin 58 can rotate, with respect to the thread guide pin 57, around a rotation axis that is parallel to the extending direction of a connection portion with the thread guide pin 57. The position of the support pin 58 with respect to the thread guide pin 57 shown in FIG. 4 is referred to as a "fifth position," and the position of the support pin 58 with respect to the thread guide pin 57 shown in FIG. 5 is referred to as a "sixth position." The support pin 58 can be switched between the fifth position and the sixth position that are two different positions.

As shown in FIG. 4, when the thread guide pin 57 is disposed in the third position, the support pin 58 disposed in the fifth position extends forward from the leading end of the thread guide pin 57, bends to the left at a predetermined bent position 580, and further extends. Hereinafter, a portion of the support pin 58 on the thread guide pin 57 side with respect to the bent position 580 is referred to as a "first portion 58A," and a portion of the support pin 58 on the opposite side to the thread guide pin 57 with respect to the bent position 580 is referred to as a "second portion 58B." When the support pin 58 is disposed in the fifth position, the directions (the front-rear direction and the left-right direction) in which the first portion 58A and the second portion 58B respectively extend are orthogonal to the direction (the up-down direction) in which the thread guide pin 57 extends.

Two sections each curved in a ring shape are formed in the second portion 58B of the support pin 58. Hereinafter, these sections are referred to as second thread guide portions 59A and 59B. The second thread guide portion 59A overlaps with a virtual line L1 that extends upward along the thread guide pin 5A disposed in the first position. The second thread guide portion 59B overlaps with a virtual line L2 that extends upward along the thread guide pin 5B disposed in the first position. The second thread guide portions 59A and 59B are held in positions that are separated upward from the thread spool base 50, by the thread guide pin 57 disposed in the third position.

The support pin 58 is disposed in the six position from the fifth position by being rotated 270 degrees clockwise in a front view with respect to the thread guide pin 57 disposed in the third position. As shown in FIG. 4 and FIG. 5, regardless of whether the support pin 58 is disposed in the fifth position or the support pin 58 is disposed in the sixth position, the direction in which the first portion 58A of the support pin 58 extends from the thread guide pin 57 is the same. The direction (the left-right direction) in which the second portion 58B of the support pin 58 disposed in the sixth position extends is parallel to the direction (the left-right direction) in which the thread guide pin 57 extends. When the thread guide pin 57 is disposed in the fourth position, the second portion 58B of the support pin 58 disposed in the sixth position extends in the left-right direction along the upper surface 50A of the thread spool base 50.

Figure 6:
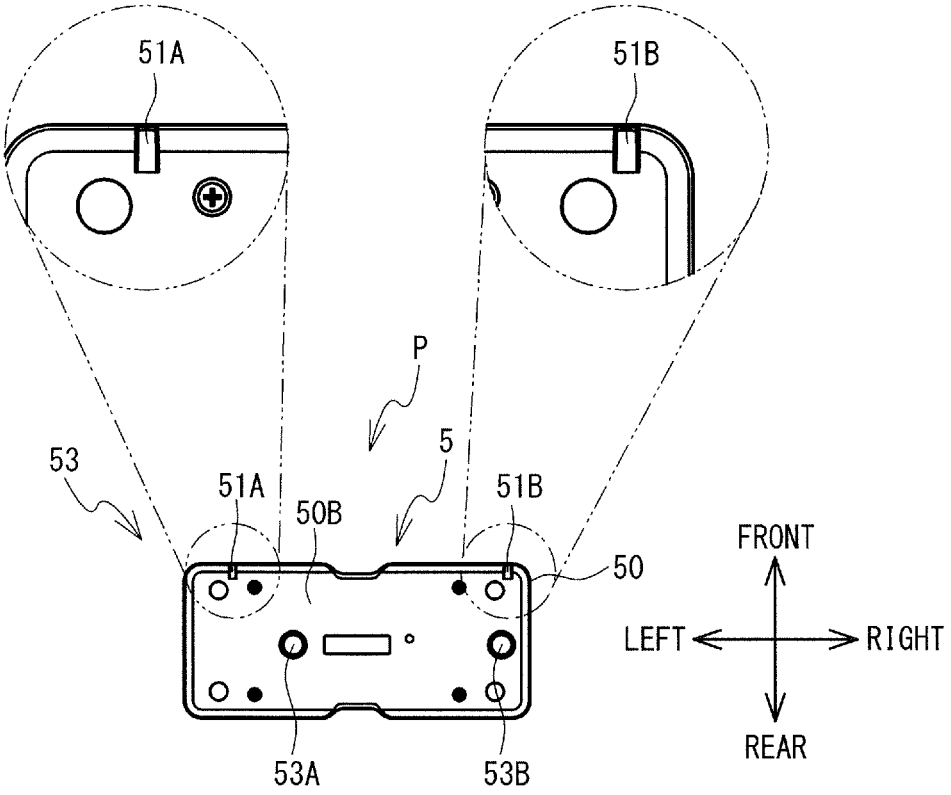
FIG. 6 is a bottom view of the thread spool device 5.

As shown in FIG. 6, the first grooves 51A and 51B, and the magnets 53A and 53B are provided in a lower surface 50B of the thread spool base 50. The first grooves 51A and 51B each extend linearly from the front end portion of the lower surface 50B toward the rear side. The first groove 51A is provided in the vicinity of the left end portion of the lower surface 50B. The first groove 51B is provided in the vicinity of the right end portion of the lower surface 50B. The first grooves 51A and 51B are aligned in the left-right direction. The distance between the first grooves 51A and 51B in the left-right direction is the same as the distance between the first convex portions 31A and 31B (refer to FIG. 3) in the left-right direction provided on the base surface 3A of the cover 3. The first convex portions 31A and 31B, and the first grooves 51A and 51B are collectively referred to as "positioning members P."

The magnets 53A and 53B are respectively provided at two positions of the lower surface 50B. More specifically, the magnets 53A and 53B are disposed to be aligned in the left-right direction, at the center of the lower surface 50B in the front-rear direction. The positional relationship between the magnets 53A and 53B matches the positional relationship between the magnets 33A and 33B provided on the upper surface 13A of the cover 3. The magnets 53A and 53B are collectively referred to as a "second attachment portion 53."

Attachment/Detachment Method of Thread Spool Device 5 With Respect to Cover 3

Figure 7:
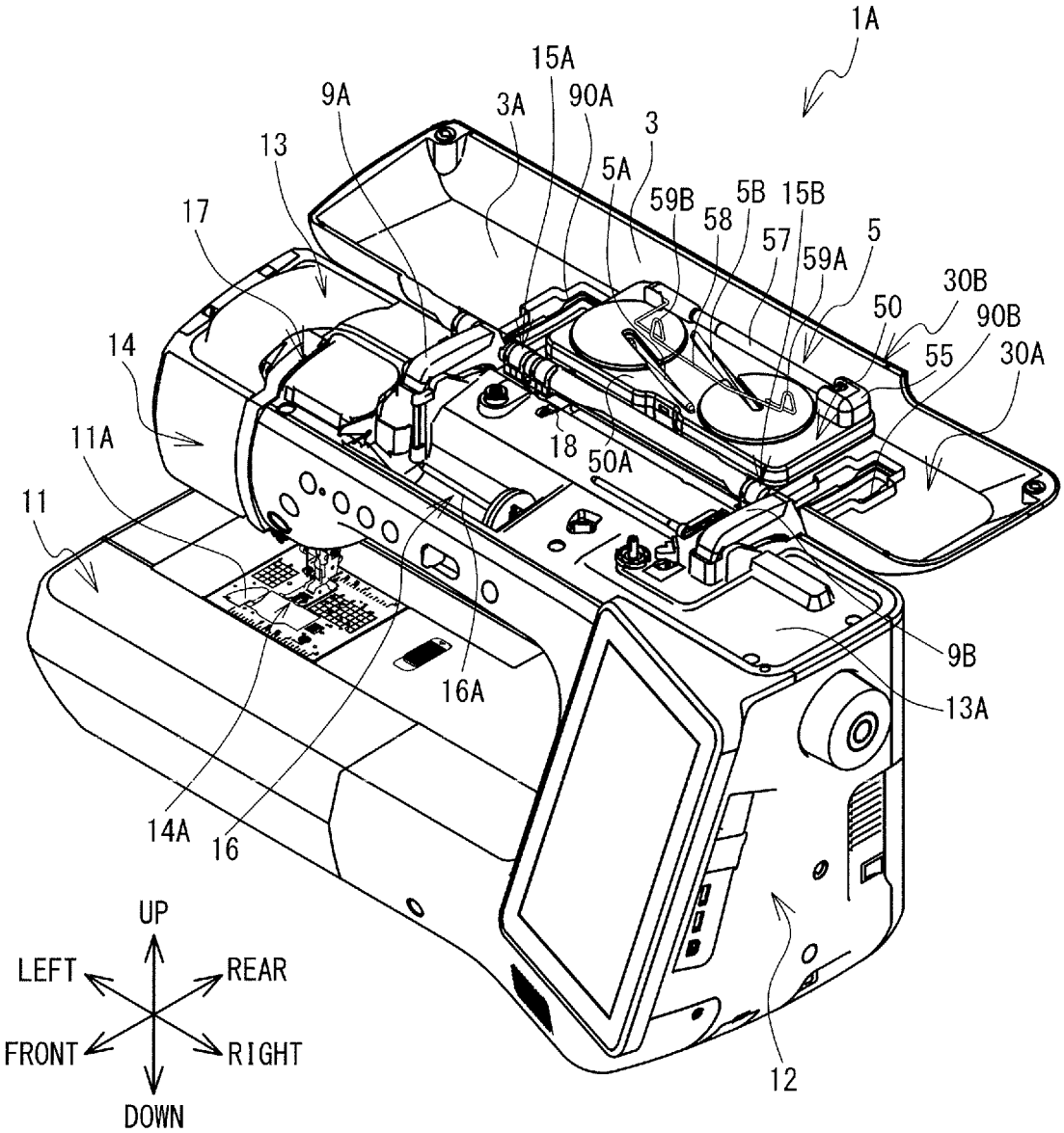
FIG. 7 is a perspective view of the sewing machine 1A on which is mounted the thread spool device 5 in which the thread spool pins 5A and 5B are each disposed in the second position, the thread guide pin 57 is disposed in the fourth position, and the support pin 58 is disposed in the sixth position.

First, the cover 3 of the sewing machine 1A is switched from the closed position to the open position. The thread spool device 5 is prepared such that the thread spool pins 5A and 5B are each disposed in the second position, the thread guide pin 57 is disposed in the fourth position, and the support pin 58 is disposed in the sixth position (refer to FIG. 5). The user places the thread spool device 5 on top of the base surface 3A (refer to FIG. 2 and FIG. 3) of the cover 3 disposed in the open position. At this time, the first convex portions 31A and 31B (refer to FIG. 3) engage with the first grooves 51A and 51B (refer to FIG. 6) of the positioning members P (refer to FIG. 3 and FIG. 6), and the thread spool device 5 is positioned with respect to the base surface 3A of the cover 3. Then, the thread spool device 5 is mounted on the cover 3 in accordance with a magnetic force that acts between the magnets 33A and 33B (refer to FIG. 3) of the first attachment portion 33 and the magnets 53A and 53B (refer to FIG. 6) of the second attachment portion 53. As shown in FIG. 7, the thread spool device 5 is mounted on the cover 3 in a state in which the thread spool pins 5A and 5B are each disposed in the second position, the thread guide pin 57 is disposed in the fourth position, and the support pin 58 is disposed in the sixth position.

Figure 8:
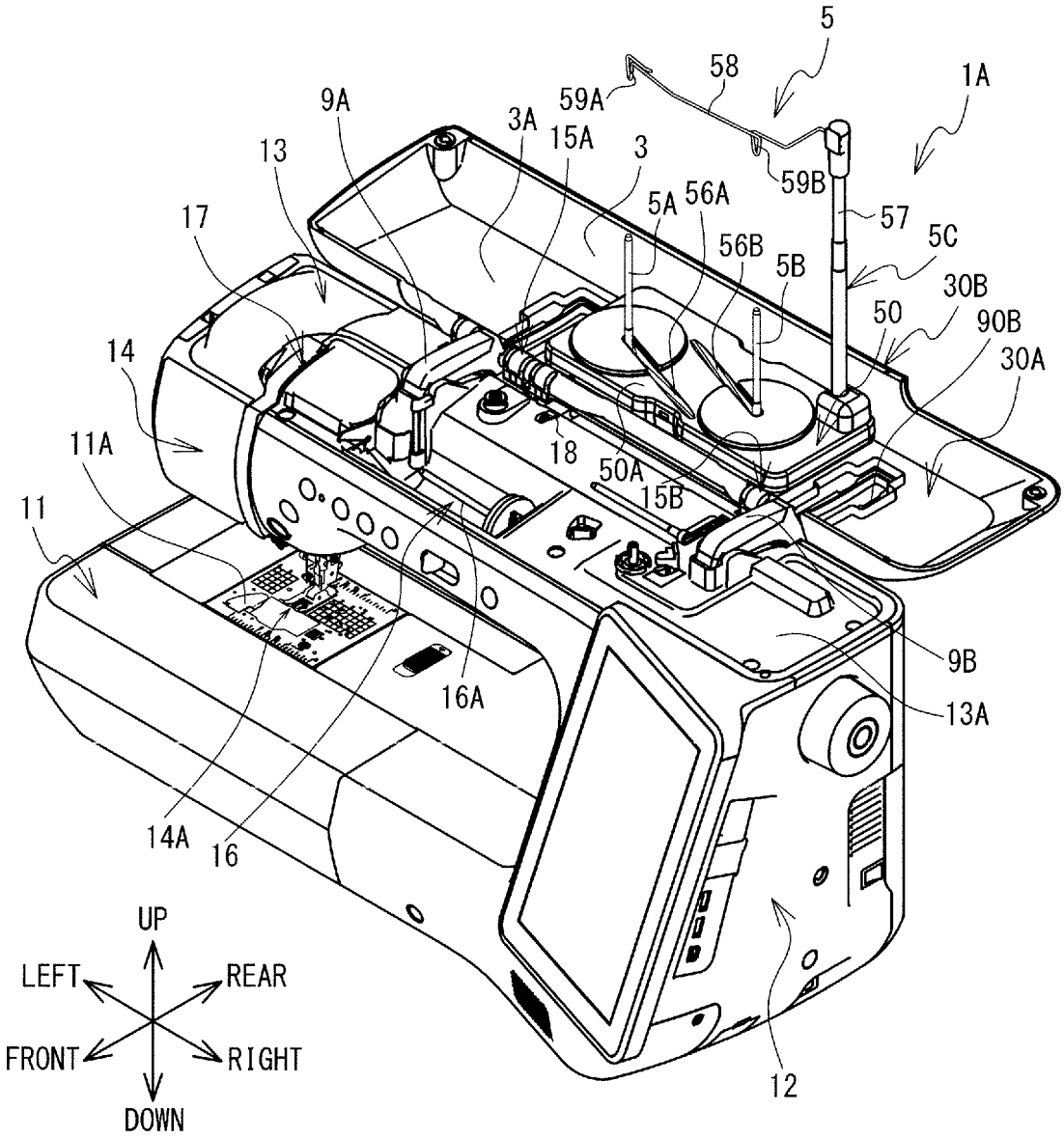
FIG. 8 is a perspective view of the sewing machine 1A on which is mounted the thread spool device 5 in which the thread spool pins 5A and 5B are each disposed in the first position, the thread guide pin 57 is disposed in the third position, and the support pin 58 is disposed in the fifth position.
Figure 9:
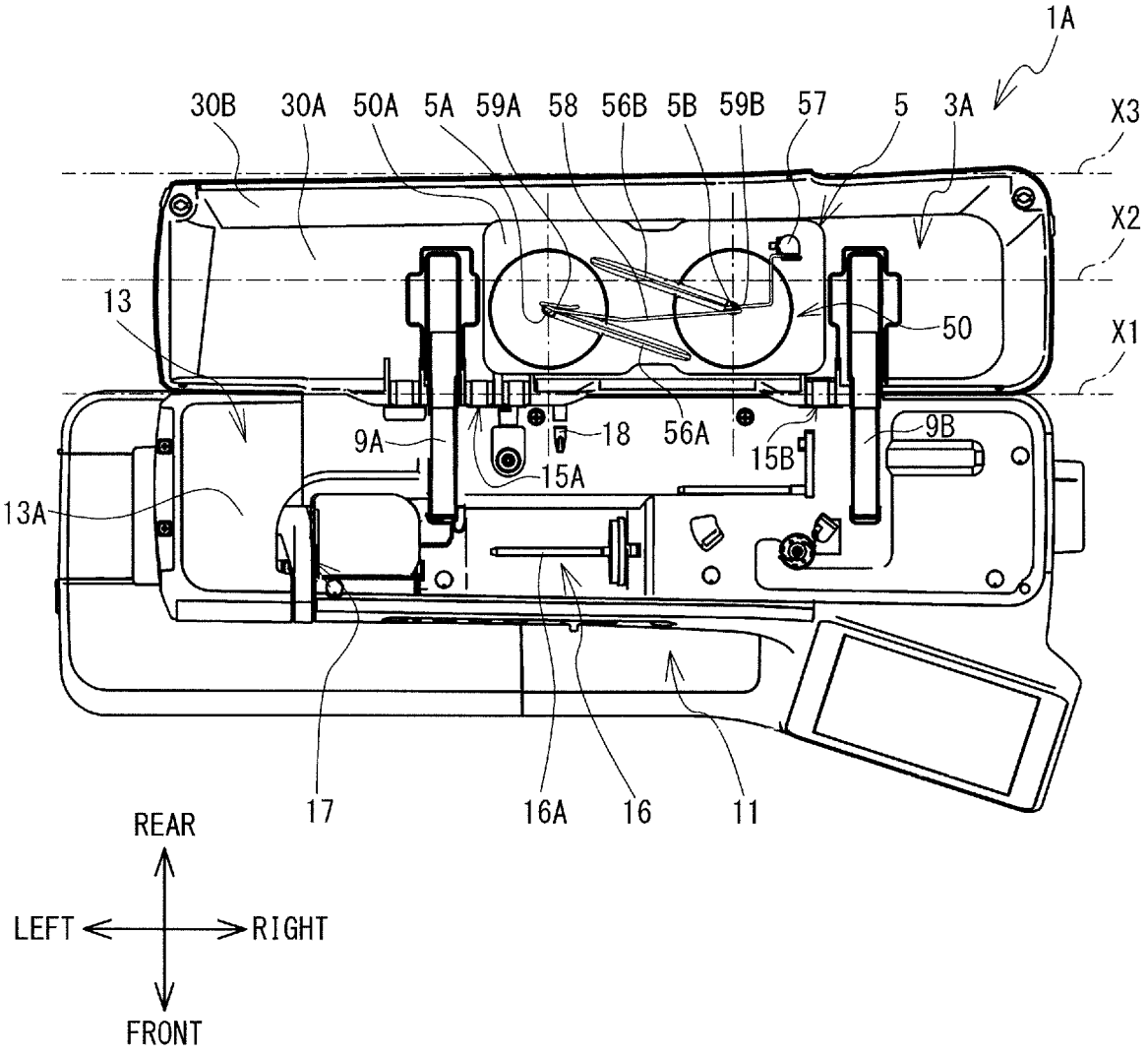
FIG. 9 is a plan view of the sewing machine 1A on which is mounted the thread spool device 5 in which the thread spool pins 5A and 5B are each disposed in the first position, the thread guide pin 57 is disposed in the third position, and the support pin 58 is disposed in the fifth position.

Next, the user pinches and pulls up the thread spool pins 5A and 5B that protrude from the upper surface 50A of the thread spool base 50. The thread spool pins 5A and 5B are switched from the second position to the first position (refer to FIG. 8). As a result, as shown in FIG. 8, the thread spool pins 5A and 5B are brought into a state in which the thread spool pins 5A and 5B are orthogonal to the base surface 3A of the cover 3 and extend upward. It is thus possible for the thread spools to be held on the thread spool pins 5A and 5B. Note that, as shown in FIG. 9, when the thread spool device 5 is placed on top of the base surface 3A of the cover 3, the first thread guide portion 18 provided on the arm portion 13 is disposed to the right of the thread spool pin 5A and to the left of the thread spool pin 5B in the left-right direction. In other words, in the left-right direction in which the arm portion 13 extends, the first thread guide portion 18 is disposed between the thread spool pins 5A and 5B switched to the first position.

Next, the user pinches the thread guide pin 57 that extends along the upper surface 50A of the thread spool base 50, rotates the thread guide pin 57 by 90 degrees clockwise in a front view, and pulls it up above the upper surface 50A. The thread guide pin 57 is switched from the fourth position to the third position (refer to FIG. 8). The user pinches the first portion 58A of the support pin 58 that extends in parallel with the thread guide pin 57, and rotates the support pin 58 by 270 degrees counterclockwise in a front view. The support pin 58 is switched from the sixth position to the fifth position (refer to FIG. 8). As a result, as shown in FIG. 8, the second thread guide portions 59A and 59B of the thread spool device 5 are brought into a state in which they can upwardly guide the upper thread from each of the thread spools held by the thread spool pins 5A and 5B. Note that the upper thread guided by each of the second thread guide portions 59A and 59B is further guided by the first thread guide portion 18 and the third thread guide portion 17 of the arm portion 13, and is guided to the sewing needle.

As shown in FIG. 9, a virtual line X3 is defined as a line that passes through the rear end portion of the cover 3 disposed in the open position and extends in the left-right direction. Note that a virtual line that passes through the front end portion of the cover 3 disposed in the open position and extends in the left-right direction matches the rotation axis X1 of the cover 3. Further, a virtual line X2 is defined as a line that passes through the center of the cover 3 in the front-rear direction and extends in the left-right direction. The distance between the rotation axis X1 and the virtual line X2 in the front-rear direction matches the distance between the virtual lines X2 and X3 in the front-rear direction. In this case, in a state in which the thread spool device 5 is mounted on the cover 3 disposed in the open position, the thread spool pins 5A and 5B disposed in the first position are disposed on the rotation axis X1 side with respect to the virtual line X2.

The thread spool device 5 is removed from the cover 3 by the second attachment portion 53 (refer to FIG. 6) being detached from the first attachment portion 33 (refer to FIG. 3) against the magnetic force that acts between the magnets 33A and 33B and the magnets 53A and 53B.

Operations and Effects of Above-Described Embodiment

The sewing machine 1A has the thread spool device 5 on the base surface 3A of the cover 3. In the state in which the cover 3 is disposed in the open position, the thread spool device 5 can hold the thread spools on the thread spool pins 5A and 5B. In other words, in the sewing machine 1A, there is no need to remove the cover 3 from the arm portion 13 in order to mount the thread spool device 5. Therefore, the user can easily cause the sewing machine 1A to be in a state in which the use of the thread spool device 5 is possible.

The sewing machine 1A is provided with the first attachment portion 33 provided on the base surface 3A of the cover 3, and the second attachment portion 53 provided on the thread spool device 5. The thread spool device 5 is mounted on the cover 3 by the second attachment portion 53 being attached to the first attachment portion 33, and is removed from the cover 3 by the second attachment portion 53 being detached from the first attachment portion 33. That is, since the thread spool device 5 can be attached to and detached from the cover 3 of the sewing machine 1A, the user can mount the thread spool device 5 on the sewing machine 1 when the user performs sewing using the thread spool device 5, and can remove the thread spool device 5 from the sewing machine 1A when the user performs sewing without using the thread spool device 5. Thus, when the thread spool device 5 is not used, the user can reduce the space for the sewing machine 1A.

The first attachment portion 33 of the cover 3 is provided with the magnets 33A and 33B, and the second attachment portion 53 of the thread spool device 5 is provided with the magnets 53A and 53B. Owing to the magnetic force of the magnets 33A, 33B, 53A and 53B that acts between the first attachment portion 33 and the second attachment portion 53, the second attachment portion 53 of the thread spool device 5 is attached to the first attachment portion 33. Thus, the sewing machine 1A can easily realize the thread spool device 5 that is detachably mounted on the cover 3, using the magnets 33A, 33B, 53A and 53B.

The base surface 3A of the cover 3 and the thread spool device 5 are provided with the positioning members P used to position the thread spool device 5 with respect to the base surface 3A. Thus, the sewing machine 1A can stabilize the position of the thread spool device 5 mounted on the cover 3, using the positioning members P.

The positioning members P include the first convex portions 31A and 31B provided on the cover 3, and the first grooves 51A and 51B provided in the thread spool device 5. The positioning members P position the thread spool device 5 with respect to the base surface 3A of the cover 3 by the first convex portion 31A being engaged with the first groove 51A and the first convex portion 31B being engaged with the first groove 51B. Thus, the sewing machine 1A can reduce a possibility of positional displacement of the thread spool device 5 positioned with respect to the base surface 3A.

The thread spool device 5 has the thread spool base 50 on which the thread spool pins 5A and 5B are provided. In the state in which the cover 3 is disposed in the open position, each of the thread spool pins 5A and 5B can be switched between the first position, in which the thread spool pins 5A and 5B extend upward from the thread spool base 50, and the second position, in which the thread spool pins 5A and 5B extend along the extending direction of the arm portion 13. Thus, by disposing each of the thread spool pins 5A and 5B in the first position when the user uses the thread spool device 5, the user can perform sewing using the upper thread of each of the thread spools held by the thread spool pins 5A and 5B. On the other hand, by disposing each of the thread spool pins 5A and 5B in the second position when the thread spool device 5 is not used, the user can downsize the sewing machine 1A.

When the thread spool pins 5A and 5B are each disposed in the first position, they are disposed to be aligned in the left-right direction, which is the extending direction of the arm portion 13. When the thread spool pins 5A and 5B are each disposed in the second position, the thread spool pin 5A extends to the right from the position Ap that corresponds to the connection portion with the thread spool base 50, and the thread spool pin 5B extends to the left from the position Bp that corresponds to the connection portion with the thread spool base 50. At this time, the thread spool pins 5A and 5B partially overlap with each other in the left-right direction. Thus, by disposing each of the thread spool pins 5A and 5B in the second position, the user can reduce the size of the sewing machine 1A in the direction (the left-right direction) in which the arm portion 13 extends.

The first thread guide portion 18 guides the upper thread drawn out from each of the thread spools respectively held by the thread spool pins 5A and 5B. In the left-right direction, the first thread guide portion 18 is disposed between the thread spool pins 5A and 5B disposed in the first position. More specifically, the first thread guide portion 18 is disposed between the position Ap and the position Bp in the left-right direction. With this configuration, the sewing machine 1A can reduce a possibility that a force that acts when the upper thread is guided by the first thread guide portion 18 may become uneven depending on whether the upper thread is drawn out from the thread spool on the thread spool pin 5A or the upper thread is drawn out from the thread spool on the thread spool pin 5B. Thus, the sewing machine 1A can smoothly draw out the upper thread from either of the thread spools on the thread spool pins 5A and 5B.

The thread spool device 5 is supported by the arm portion 13 via the rotation axis X1. Here, in the state in which the cover 3 is disposed in the open position, the thread spool pins 5A and 5B are disposed on the rotation axis X1 side of the cover 3 with respect to the virtual line X2 that passes through the center of the cover 3, in the front-rear direction that is orthogonal to the directions (the up-down direction and the left-right direction) in which the pillar 12 and the arm portion 13 respectively extend. Thus, in the sewing machine 1A, the thread spool device 5 can be stably supported by the arm portion 13, in comparison to when the thread spool pins 5A and 5B are disposed on the opposite side to the rotation axis X1 side of the cover 3 with respect to the virtual line X2.

The thread guide pin 57 can be switched between the third position in which the thread guide pin 57 extends upward from the thread spool base 50 and the fourth position in which the thread guide pin 57 extends along the left-right direction. Therefore, by disposing the thread guide pin 57 in the fourth position when the thread spool device 5 is not used, the user can downsize the sewing machine 1A.

The thread spool pins 5A and 5B extend in the up-down direction when the thread spool pins 5A and 5B are each disposed in the first position. This direction is a direction orthogonal to the upper surface 13A and the base surface 3A, and is also a direction parallel to the extending direction of the pillar 12. With this configuration, the thread spool pins 5A and 5B can receive, from the base surface 3A of the cover 3, the force received from the thread spools in the held state. Thus, in comparison to when the thread spool pins 5A and 5B extend in parallel with the upper surface 13A, the sewing machine 1A can reduce the strength that is required to hold the thread spools.

First Modified Example

A sewing machine 1B according to a first modified example of the present disclosure will be explained with reference to FIG. 10 and FIG. 11. The sewing machine 1B is different from the sewing machine 1A in that a second convex portion 32B is provided on the cover 3 and a thread spool device 6 is mounted on the cover 3. The thread spool device 6 is different from the thread spool device 5 in that it has a through hole 52B and a transmission portion 54B. Other structural elements are the same as those of the sewing machine 1A. Structural elements that are the same as those of the sewing machine 1A and the thread spool device 5 are denoted by the same reference numerals and an explanation thereof is omitted here.

Figure 10:
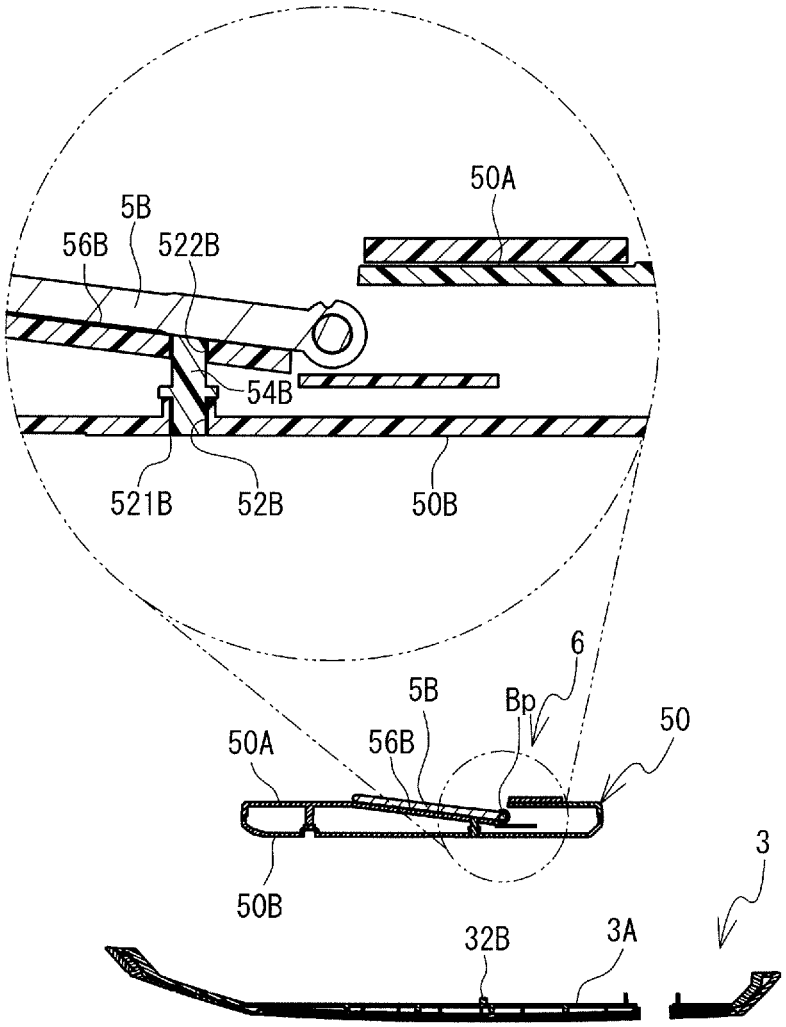
FIG. 10 is a cross-sectional view of the cover 3 and a thread spool device 6 according to a first modified example, in which the thread spool pin 5B is disposed in the second position.

As shown in FIG. 10, the through hole 52B of the thread spool device 6 communicates with a space between the lower surface 50B of the thread spool base 50 of the thread spool device 6 and the second groove 56B. The through hole 52B extends in the up-down direction. An opening that is formed in the lower surface 50B by the through hole 52B is referred to as a "first opening 521B." An opening that is formed in the second groove 56B by the through hole 52B is referred to as a "second opening 522B. The through hole 52B extends in the up-down direction between the first opening 521B and the second opening 522B. The transmission portion 54B has a bar shape and is disposed inside the through hole 52B. The transmission portion 54B can move in the up-down direction along the through hole 52B.

The second convex portion 32B protrudes from the base surface 3A of the cover 3. In a state in which the cover 3 is disposed in the open position, the second convex portion 328 protrudes upward. In a state in which the thread spool device 6 is mounted on the cover 3, the second convex portion 32B is disposed below the through hole 52B.

Note that, although not shown in the drawings, the thread spool device 6 further includes a through hole that communicates with a space between the lower surface 50B and the second groove 56A, and a transmission portion that is disposed inside the through hole. The cover 3 further includes a second convex portion that is disposed below the through hole that communicates with the second groove 56A.

Figure 11:
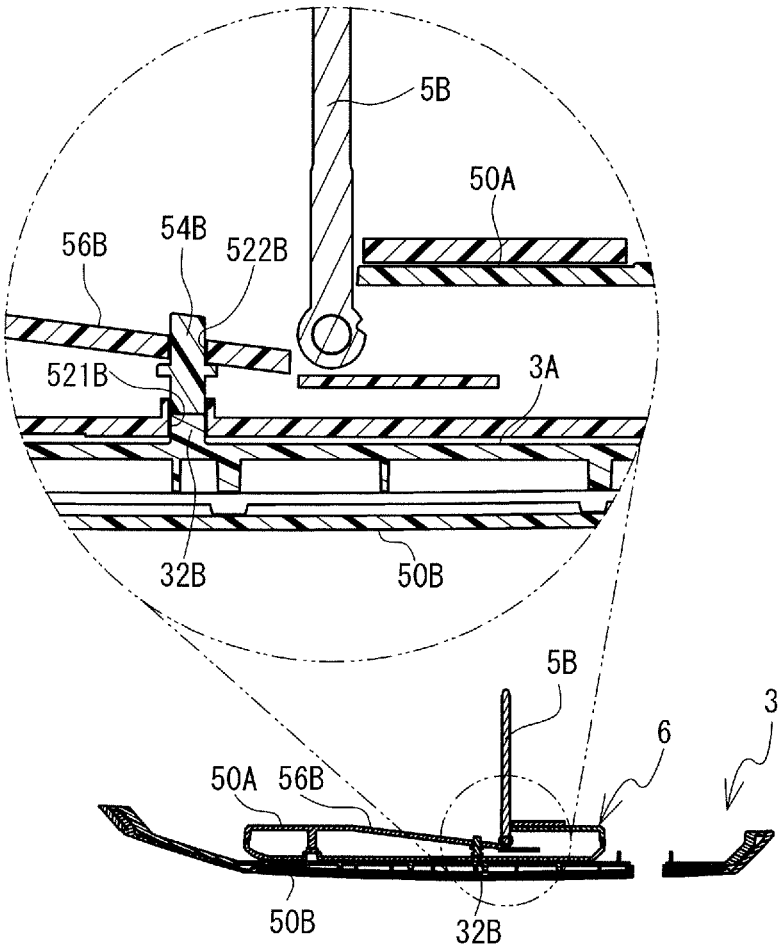
FIG. 11 is a cross-sectional view of the cover 3 and the thread spool device 6 according to the first modified example, in which the thread spool pin 5B is disposed in the first position.

When the thread spool device 6 is mounted on the cover 3 in a state in which the thread spool pin 5B is disposed in the second position, the second convex portion 32B is inserted through the first opening 521B of the through hole 52B (refer to FIG. 11). The second convex portion 32B of the cover 3 comes into contact, from below, with the lower end portion of the transmission portion 54B disposed inside the through hole 52B. The transmission portion 54B moves upward, and the upper end portion thereof protrudes from the second opening 522B of the second groove 56B. The transmission portion 54B transmits, to the thread spool pin 5B disposed inside the second groove 56B, a force in a direction toward the first position. Since a protruding amount of the thread spool pin 5B with respect to the upper surface 50A of the thread spool device 6 increases, it becomes easy for the user to pinch and pull up the thread spool pin 5B. As shown in FIG. 11, when the user pinches and pulls up the thread spool pin 5B, the thread spool pin 5B is switched from the second position to the first position. Although a detailed explanation is omitted, this also applies to the thread spool pin 5A.

Operations and Effects of First Modified Example

In the sewing machine 1B, the second convex portion 32B is inserted through the first opening 521B by the operation of mounting the thread spool device 6 on the cover 3, and the thread spool pin 5B is moved from the second position toward the first position so that the thread spool pin 5B can protrude from the second groove 56B. The user of the sewing machine 1B can cause the thread spool pin 5B to protrude significantly from the second groove 56B, simply by performing the operation of mounting the thread spool device 6 on the cover 3. With this configuration, the user can easily pinch the thread spool pin 5B and move it to the first position. This also applies to the thread spool pin 5A.

Second Modified Example

Figure 12:
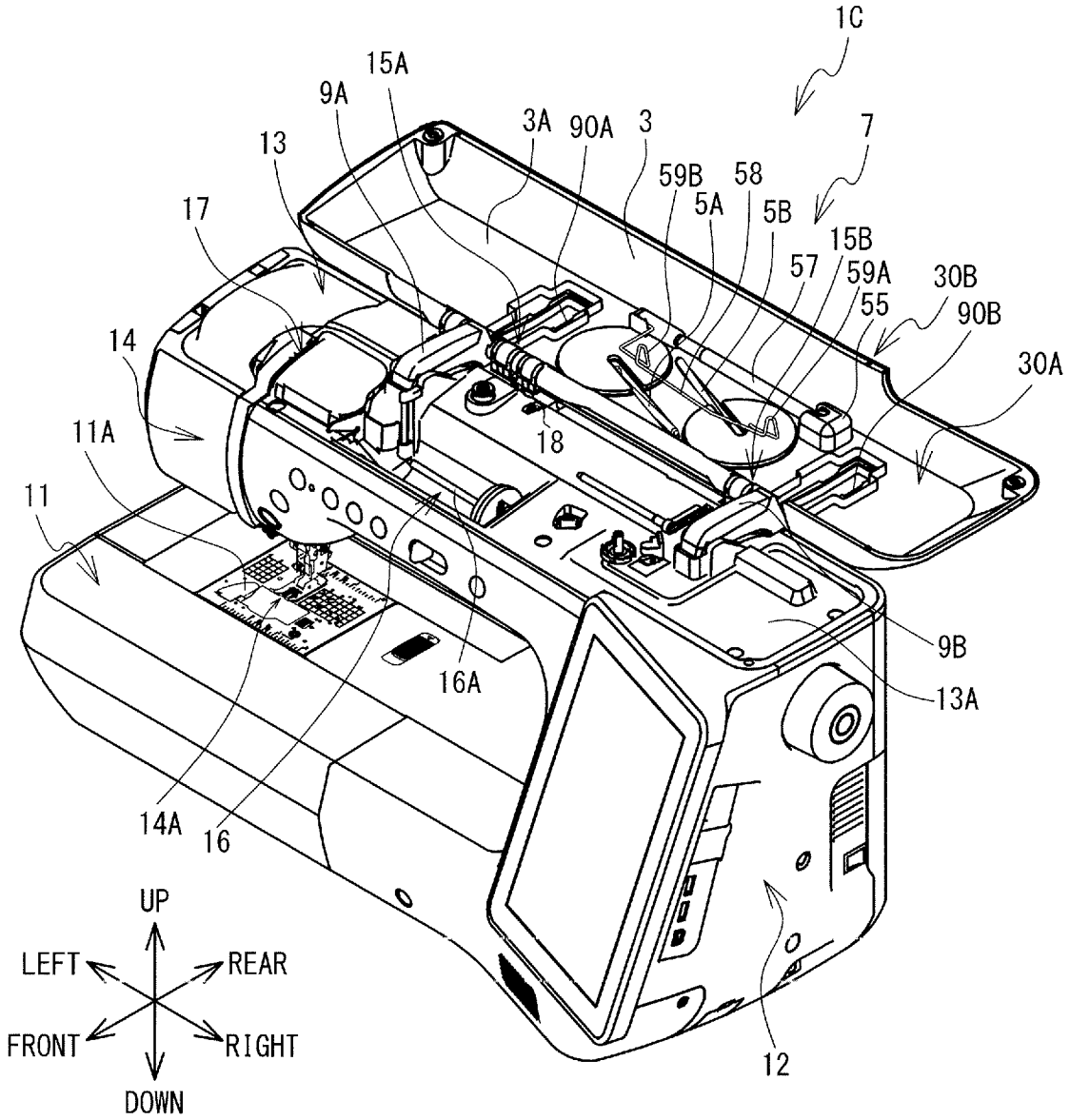
FIG. 12 is a perspective view of a sewing machine 1C including a thread spool device 7 in which the thread spool pins 5A and 5B are each disposed in the second position, the thread guide pin 57 is disposed in the fourth position, and the support pin 58 is disposed in the sixth position.
Figure 13:
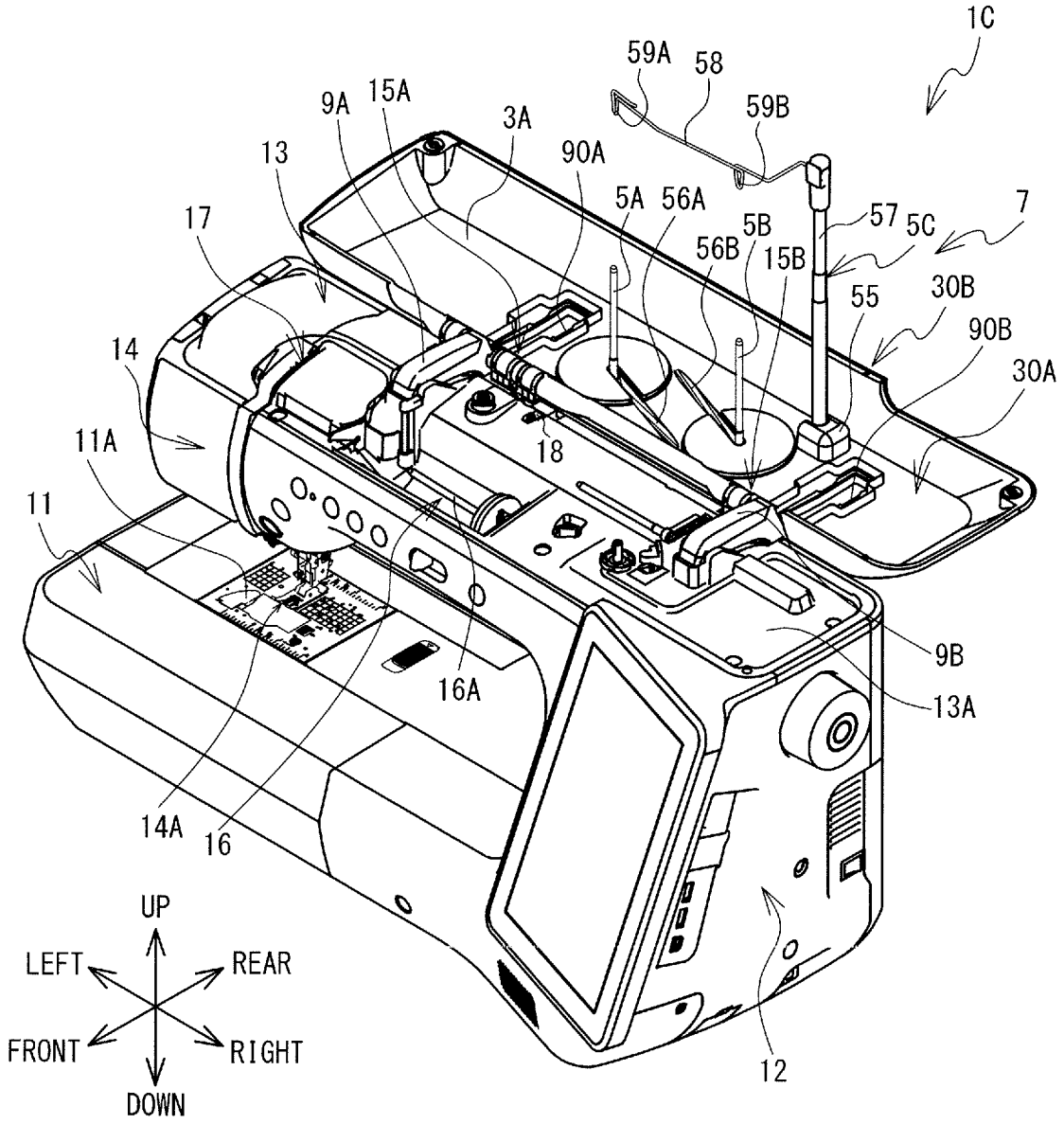
FIG. 13 is a perspective view of the sewing machine 1C including the thread spool device 7 in which the thread spool pins 5A and 5B are each disposed in the first position, the thread guide pin 57 is disposed in the third position, and the support pin 58 is disposed in the fifth position.

A sewing machine 1C according to a second modified example of the present disclosure will be explained with reference to FIG. 12 and FIG. 13. The sewing machine 1C is different from the sewing machine 1A in that a thread spool device 7 is directly provided on the cover 3 and is not detachable. Other structural elements are the same as those of the sewing machine 1A. Structural elements that are the same as those of the sewing machine 1A and the thread spool device 5 are denoted by the same reference numerals and an explanation thereof is omitted here.

The thread spool device 7 includes the thread spool pins 5A and 5B having the same configuration as the thread spool device 5 (refer to FIG. 4 and FIG. 5), the thread guide mechanism 5C (the thread guide pin 57 and the support pin 58 (the second thread guide portions 59A and 59B)), the protruding portion 55 and the second grooves 56A and 56B. The second grooves 56A and 56B and the protruding portion 55 are directly provided on the base surface 3A of the cover 3. Each of the thread spool pins 5A and 5B is rotatably supported with respect to the cover 3, around an axis that is orthogonal to the extending direction. Each of the thread spool pins 5A and 5B can be switched between the first position (refer to FIG. 13) and the second position (refer to FIG. 12). The thread guide pin 57 is supported by the protruding portion 55 provided on the cover 3, such that the thread guide pin 57 can rotate around an axis that is orthogonal to the extending direction of the thread guide pin 57. The thread guide pin 57 can be switched between the third position (refer to FIG. 13) and the fourth position (refer to FIG. 12). The support pin 58 is supported by the thread guide pin 57 such that the support pin 58 can rotate around an axis that is parallel to the extending direction of the first portion 58A. The support pin 58 can be switched between the fifth position (refer to FIG. 13) and the sixth position (refer to FIG. 12).

When the user causes the thread spool device 7 of the sewing machine 1C to be in a usable state, first, the user switches the cover 3 from the closed position to the open position. The base surface 3A of the cover 3 is directed upward. As shown in FIG. 12, the thread spool device 7 is exposed in a state in which the thread guide pins 5A and 5B are each disposed in the second position, the thread guide pin 57 is disposed in the fourth position, and the support pin 58 is disposed in the sixth position. Next, the user pinches and pulls up the thread spool pins 5A and 5B that protrude from the base surface 3A, and switches the thread spool pins 5A and 5B from the second position to the first position. As a result, as shown in FIG. 13, the thread spool pins 5A and 5B are brought into a state in which they are orthogonal to the base surface 3A of the cover 3 and extend upward. It is thus possible for the thread spools to be held on the thread spool pins 5A and 5B. Next, the user pinches and pulls up the thread guide pin 57 that extends along the base surface 3A, and switches the thread guide pin 57 from the fourth position to the third position. The user pinches the first portion 58A of the support pin 58 that extends in parallel with the thread guide pin 57, and rotates the support pin 58 by 270 degrees counterclockwise in a front view, thus switching the support pin 58 from the sixth position to the fifth position. As a result, as shown in FIG. 13, the second thread guide portions 59A and 59B of the thread spool device 7 are brought in to a state in which they can upwardly guide the upper thread from each of the thread spools held by the thread spool pins 5A and 5B. Thus, the thread spool device 7 is brought into the usable state.

On the other hand, when the thread spool device 7 is not used, so that the cover 3 can be disposed in the closed position, the user switches the support pin 58 from the fifth position to the six position, switches the thread guide pin 57 from the third position to the fourth position, and switches each of the thread spool pins 5A and 5B from the first position to the second position. As a result, the thread spool device 7 can be accommodated between the upper surface 13A of the arm portion 13 and the base surface 3A of the cover 3. By rotating the cover 3, the user switches the cover 3 from the open position to the closed position.

Operations and Effects of Second Modified Example

In the second modified example, the thread spool device 7 is not detachable from the cover 3. Therefore, when the thread spool device 7 is not used, the user need not secure the space to store the thread spool device 7.

Other Modified Examples

The present disclosure is not limited to the above-described embodiment, and various modifications are possible. Hereinafter, although the sewing machine 1A (the thread spool device 5) is used as an example to explain modified examples, it is needless to mention that the modified examples can be applied not only to the sewing machine 1A but also to the sewing machine 1B (the thread spool device 6) and the sewing machine 1C (the thread spool device 7).

The magnets 33A and 33B may only be provided on the first attachment portion 33 of the cover 3, and the magnets 53A and 53B need not necessarily be provided on the second attachment portion 53 of the thread spool device 5. For example, a ferromagnetic material (iron or the like) that can generate a magnetic force between itself and the magnets 33A and 33B may be used as the second attachment portion 53. Meanwhile, the magnets 53A and 53B may only be provided on the second attachment portion 53 of the thread spool device 5, and the magnets 33A and 33B need not necessarily be provided on the first attachment portion 33 of the cover 3. For example, a ferromagnetic material (iron or the like) that can generate a magnetic force between itself and the magnets 53A and 53B may be used as the first attachment portion 33. The first attachment portion 33 and the second attachment portion 53 may attach the thread spool device 5 to the cover 3 without using the magnetic force. For example, the first attachment portion 33 and the second attachment portion 53 may be formed in shapes such that they can engage with each other. The thread spool device 5 may be attached to the cover 3 by the first attachment portion 33 and the second attachment portion 53 engaging with each other. The first attachment portion 33 and the second attachment portion 53 may be a screw and a screw hole that can be screwed together. Further, the cover 3 may be provided with an attachment portion, and the thread spool device 5 need not necessarily be provided with an attachment portion. In this case, the attachment portion of the cover 3 may have a rib corresponding to the outer circumference of the thread spool base 50 of the thread spool device 5, and the thread spool device 5 may be attached to the cover 3 by the thread spool base 50 being disposed in an area surrounded by the rib.

The positioning members P may include a first groove provided in the base surface 3A of the cover 3, and a first convex portion provided on the thread spool device 5. The positioning members P may perform the positioning of the thread spool device 5 with respect to the base surface 3A of the cover 3, using a configuration other than the first grooves and the first convex portions. For example, the positioning members P may perform the positioning of the thread spool device 5 with respect to the base surface 3A of the cover 3, using magnetic forces of magnets that are respectively provided on the base surface 3A of the cover 3 and on the thread spool device 5. The sewing machine 1A need not necessarily have the positioning members P.

The thread spool pin 5A disposed in the second position may extend to the left from the position Ap. The thread spool pin 5B disposed in the second position may extend to the right from the position Bp. In the state in which the thread spool pins 5A and 5B are each disposed in the second position, they need not necessarily overlap with each other in the left-right direction.

In the left-right direction, the first thread guide portion 18 need not necessarily be disposed between the thread spool pins 5A and 5B disposed in the first position. For example, the first thread guide portion 18 need not necessarily be provided on the arm portion 13. In this case, in place of the first thread guide portion 18, the third thread guide portion 17 may directly guide the upper thread drawn out from each of the thread spools held by the thread spool pins 5A and 5B.

The number of the thread spool pins 5A and 5B need not necessarily be limited to two, and may be one, or three or more. The thread spool pins 5A and 5B may be fixed in the first position and may not be switchable to the second position. The thread guide pin 57 may be fixed in the third position and may not be switchable to the fourth position. The thread spool device 5 may be provided on the cover 3 on the opposite side to the rotation axis X1 with respect to the virtual line X2. The thread spool device 5 may include only the thread spool pins 5A and 5B and need not necessarily include the thread guide mechanism 5C.

In the first modified example, the transmission portion 54B need not necessarily be provided inside the through hole 52B. For example, the second convex portion 32B of the cover 3 may be longer than the length of the through hole 52B. When the thread spool device 6 is mounted on the cover 3, the second convex portion 32B may be inserted through the through hole 52B and may protrude upward from the second groove 56B. The second convex portion 32B may directly move the thread spool pin 5B disposed in the second groove 56B, from the second position toward the first position.

The extending direction of each of the thread spool pins 5A and 5B disposed in the first position need not necessarily be exactly orthogonal to the base surface 3A of the cover 3, and may be inclined with respect to the direction orthogonal to the base surface 3A.

What is claimed is:

1. A sewing machine comprising:

a bed portion;

a pillar extending upward from the bed portion;

an arm portion extending from an upper end portion of the pillar in parallel with the bed portion;

a cover provided on the arm portion and configured to be rotatable between a closed position and an open position, the closed position being a position in which a base surface, which is a part of a surface of the cover, faces an upper side of the arm portion and the base surface covers the upper side of the arm portion, and the open position being a position in which the base surface, is directed upward and the base surface does not cover the upper side of the arm portion at all; and a thread spool device provided on the base surface and including at least one thread spool pin, the thread spool device being capable of holding a thread spool on each of the at least one thread spool pin in a state in which the cover is disposed in the open position.

2. The sewing machine according to claim 1, further comprising:

a first attachment portion provided on the base surface of the cover; and a second attachment portion provided on the thread spool device, wherein the thread spool device is mounted on the cover by the second attachment portion being attached to the first attachment portion, and the thread spool device is removed from the cover by the second attachment portion being detached from the first attachment portion.

3. The sewing machine according to claim 2, wherein at least one of the first attachment portion and the second attachment portion is a magnet, and the second attachment portion is attached to the first attachment portion by a magnetic force of the magnet that acts between the first attachment portion and the second attachment portion.

4. The sewing machine according to claim 2, wherein at least one of the base surface and the thread spool device includes a positioning member configured to position the thread spool device with respect to the base surface.

5. The sewing machine according to claim 4, wherein the positioning member includes a first convex portion and a first groove, the first convex portion being provided on one of the base surface and the thread spool device, and the first groove being provided on the other of the base surface and the thread spool device, and the thread spool device is positioned with respect to the base surface by the first convex portion engaging with the first groove.

6. The sewing machine according to claim 1, wherein the thread spool device includes a thread spool base on which the at least one thread spool pin is provided, each of the at least one thread spool pin is switchable between a first position and a second position in a state in which the cover is disposed in the open position, in the first position, the at least one thread spool pin extends upward from the thread spool base, and in the second position, the at least one thread spool pin extends along an extending direction of the arm portion.

7. The sewing machine according to claim 2, wherein the cover includes a second convex portion that protrudes from the base surface, the thread spool device includes a thread spool base on which the at least one thread spool pin is provided, each of the at least one thread spool pin is switchable between a first position and a second position in a state in which the cover is disposed in the open position, in the first position, the at least one thread spool pin extends upward from the thread spool base, in the second position, the at least one thread spool pin extends along an extending direction of the arm portion, the thread spool device includes a second groove and a transmission portion, each of the at least one thread spool pin disposed in the second position enters into the second groove, the transmission portion is capable of transmitting a force, in a direction toward the first position, to the at least one thread spool pin disposed in the second position, and when the thread spool device is mounted on the cover, the force is transmitted to the at least one thread spool pin by a portion of the transmission portion coming into contact with the second convex portion and another portion of the transmission portion protruding from the second groove.

8. The sewing machine according to claim 2, wherein the cover includes a second convex portion that protrudes from the base surface, the thread spool device includes a thread spool base on which the at least one thread spool pin is provided, each of the at least one thread spool pin is switchable between a first position and a second position in a state in which the cover is disposed in the open position, in the first position, the at least one thread spool pin extends upward from the thread spool base, in the second position, the at least one thread spool pin extends along an extending direction of the arm portion, the thread spool device includes a second groove and a through hole, each of the at least one thread spool pin disposed in the second position enters into the second groove, and when the thread spool device is mounted on the cover, the through hole extends between a first opening, through which the second convex portion is inserted, and a second opening formed in the second groove.

9. The sewing machine according to claim 6, wherein the at least one thread spool pin is two thread spool pins, in a state in which the two thread spool pins are each disposed in the first position, the two thread spool pins are disposed to be aligned in the extending direction of the arm portion such that one of the two thread spool pins is disposed on one side in the extending direction of the arm portion, with respect to the other of the two thread spool pins, and in a state in which the two thread spool pins are each disposed in the second position, one of the two thread spool pins extends toward the other side in the extending direction of the arm portion from a connection portion of the one thread spool pin with the thread spool base, and the other of the two thread spool pins extends toward the one side in the extending direction of the arm portion from a connection portion of the other thread spool pin with the thread spool base.

10. The sewing machine according to claim 1, wherein the at least one thread spool pin is two thread spool pins, the arm portion includes a first thread guide portion, the first thread guide portion is disposed between the two thread spool pins in a direction that is parallel to the extending direction of the arm portion, and guides a sewing thread drawn out from the thread spool held by each of the two thread spool pins.

11. The sewing machine according to claim 1, wherein the cover is provided on the arm portion such that the cover is rotatable around a rotation axis that is parallel to the extending direction of the arm portion, and in a state in which the cover is disposed in the open position, the at least one thread spool pin is disposed on the rotation axis side with respect to a center of the cover, in a direction orthogonal to directions in which the pillar and the arm portion respectively extend.

12. The sewing machine according to claim 1, wherein the thread spool device includes a thread spool base, at least one second thread guide portion and a thread guide pin, the at least one thread spool pin is provided on the thread spool base, in a state in which the cover is disposed in the open position, the at least one second thread guide portion upwardly guides a sewing thread drawn out from the thread spool held by each of the at least one thread spool pin, in the state in which the cover is disposed in the open position, the thread guide pin holds the at least one second guide portion in a position separated upward from the thread spool base, the thread guide pin is switchable between a third position and a fourth position, in the third position, the thread guide pin extends upward from the thread spool base, and in the fourth position, the thread guide pin extends along the extending direction of the arm portion.

13. The sewing machine according to claim 1, wherein the at least one thread spool pin extends in a direction that is orthogonal to the base surface and that is parallel to the pillar.

14. The sewing machine according to claim 1, wherein, with the cover in the open position, and when viewed from a top of the sewing machine in an up-down direction, the base surface does not overlap the upper side of the arm portion.

* * * * *